US007703809B2

(12) United States Patent
Zaitsevsky

(10) Patent No.: US 7,703,809 B2
(45) Date of Patent: Apr. 27, 2010

(54) PRINTED PRODUCT AND METHOD FOR THE PRODUCTION THEREOF

(75) Inventor: Alexei Vadimovich Zaitsevsky, Vilnjus (RU)

(73) Assignee: Milimarex Limited, Limasol (CY)

( * ) Notice: Subject to any disclaimer, the term of this patent is extended or adjusted under 35 U.S.C. 154(b) by 1161 days.

(21) Appl. No.: 10/552,893

(22) PCT Filed: Oct. 27, 2004

(86) PCT No.: PCT/RU2004/000425

§ 371 (c)(1),
(2), (4) Date: Oct. 13, 2005

(87) PCT Pub. No.: WO2005/022972

PCT Pub. Date: Mar. 17, 2005

(65) Prior Publication Data

US 2007/0085898 A1 Apr. 19, 2007

(30) Foreign Application Priority Data

Aug. 11, 2004 (RU) ..... 2004124540

(51) Int. Cl.
*B42D 15/00* (2006.01)
*B42D 15/10* (2006.01)

(52) U.S. Cl. ..... 283/72; 283/901; 283/902

(58) Field of Classification Search ..... 283/113, 283/117, 72, 85, 87, 89, 90, 901, 902, 91, 283/93; 399/366; 428/195.1, 29, 30, 915, 428/916; 358/1.1, 1.9, 3.01, 3.06
See application file for complete search history.

(56) References Cited

U.S. PATENT DOCUMENTS 5,315,407 A * 5/1994 Sakamoto et al. ..... 358/3.07

(Continued)

FOREIGN PATENT DOCUMENTS

LT 4922 6/2002

(Continued)

OTHER PUBLICATIONS

English Abstract of LT2000110 dated Feb. 25, 2002.

(Continued)

*Primary Examiner*—Dana Ross
*Assistant Examiner*—Pradeep C Battula
(74) *Attorney, Agent, or Firm*—Ladas & Parry LLP

(57) ABSTRACT

The printed product comprises a carrier of a main image applied thereon transmitted by an ordered screen having a specified angle and lineature and at least one additional latent image which is hidden from visualization and transmitted by a deformed-structure screen. Said latent image can be visualized when it is applied to the printed product of a test pattern embodied in the form of a transparent substrate which is provided with a linear screen applied thereto and which angle and lineature are identical to specified angle and lineature. Depending on the type of the screen deformation the latent image is displayable with preserved tints or in the form of contour lines. The method for producing of the printed product consists in introducing distortions in the ordered screen by shifting the centers of the screen grid structure or by inserting modified elements into the ordered screen said elements being embodied in the form of transition between the types of said ordered screen elements.

8 Claims, 4 Drawing Sheets

U.S. PATENT DOCUMENTS

| | | | | |
|---|---|---|---|---|
| 5,396,559 | A | 3/1995 | McGrew | |
| 5,790,703 | A * | 8/1998 | Wang | 358/3.28 |

FOREIGN PATENT DOCUMENTS

| | | |
|---|---|---|
| RU | 2 138 401 | 9/1999 |
| RU | 2 151 071 | 6/2000 |
| RU | 2 176 823 | 12/2001 |
| RU | 2 191 118 | 10/2002 |

OTHER PUBLICATIONS

English Abstract and Partial English Translation of RU 2 176 823 dated Dec. 10, 2001.

English Abstract and Partial English Translation of RU 2 151 071 dated Jun. 20, 2000.

English Abstract and Partial English Translation of RU 2 191 118 dated Oct. 20, 2002.

English Abstract and Partial English Translation of RU 2138401 dated Sep. 27, 1999.

* cited by examiner

PRINTED PRODUCT AND METHOD FOR THE PRODUCTION THEREOF

FIELD OF THE INVENTION

The present invention relates to the field of polygraphy and particularly to a printed product containing at least one latent image which is hidden from visualization carrying out in a particular case a function of printed product counterfeit protection and to the methods of production thereof.

DESCRIPTION OF THE PRIOR ART

It is known a printed product containing an additional latent image, in particular, a drawing, a pattern or an inscription, intended for its protection against fakes of malefactors. Thus the most wide spread are the methods of production of such products in which a protective latent image is introduced at a step of the layout sheet preparation that allows to provide for the document a high degree of security. Preparation of the layout sheet with protection in the majority of publications is a single operation that is economically reasonable at printing of large circulations, since it allows to employ usual and inexpensive industrial production technologies.

However the prompt evolution of copying technical equipment requires more and more serious approach to the problem of protection of printed products from falsification. To complicate the process of copying or unauthorized reproduction of a printed product the protective effects executed in the layout sheet of the document should be sufficiently thin to inevitably produce lapses and inaccuracy at scanning, these elements of the latent protective pattern should be complex and irregular to be difficult to reiterate, outline, duplicate, retouch, and elements of different colors should be superimposed on each other so that after scanning they were difficult to divide into different layers. Accomplishment of all these conditions makes the process of the layout sheet preparation complex and labor-consuming.

The majority of the known printed products and methods for production thereof at which a latent image is introduced at a step of the layout sheet preparation, in particular, at a step of half-tone screening appear to be difficulty implemented and impractical from the point of view of technological peculiarities of manufacture. As a rule, the literature in detail describes parameters of a non-uniform screen only for some special cases, but not a method of construction of such screen. Significant irregularity of the screen structure, and also a complex form of its elements lead to printing problems because of the dot spread effect and other inevitable deformation of the screen elements at different steps of production. Undesirable effects include, among the other, appearing of a non-uniform moiré, displaying images and patterns which should remain invisible, and also significant tone deviations in the screened image. Appearing of undesirable effects is less noticeably at use of a larger screen, but protective effect thus decreases transforming the protective image to an ornamental element. Absence of a simple and convenient for an ordinary user method and tool for authentication of the printed product limits the scope of the described protective effects.

It is known a method for producing a printed product by separation the image to zones with different values of lineature and angle of the screen construction, and form of the screen elements described in patent RU-A-2191118. However because of presence of strict boundary lines between the separate zones on the image in the printed product made by such method these sections will be easily discernible for a malefactor, and using sufficiently fine screen can be distinctly distinguished by tone. Besides such type of "application" from screens with different parameters can be easily executed in different widely spread graphical editors.

It is also known a printed product made by a method in which a latent image is written in the screen of the main image by shifting its fragments on a certain part of period of the screen constructing elements described in patent RU-A-2151071. Thus the same division on zones of the screened areas is actually carried out as in the method described in patent RU-A-2191118. The same technical deficiencies that has been mentioned above are inherent to the described method.

It is known a method for producing of a printed product by application a latent image in course of construction of the pattern of lines having not constant arrangement period described in patent RU-A-2138401, thus this can result in a non-uniform moiré at scanning and reprinting. This method can be considered as a particular alternative of raster structure deformation though it rather relates to vector graphics. Observance of relation specified in the work between the period and the line thickness is not sufficient to compensate the dot spread effect at printing.

It is known a printed product disclosed in patent RU-A-2176823 manufactured by recording one or more latent images in the main image screen and using convexo-convex lenses of certain density for developing thereof. In the given method complex form screen elements are formed to record the latent image, and in order to record two and more latent images the screen is fragmented on zones. Thus because of quite complex form of the screen elements, non-uniform tone distortions can appear on the printed product, and when the full-color printing is used distortion becomes apparent, as a rule, even more strongly, since half-tone screening of different color layers is proposed to carry out by different methods.

It is known a printed product containing a carrier of a main image applied thereon, the main image being transmitted by an ordered screen, and having at least one additional latent image transmitted by a deformed-structure screen, disclosed in LT-A-4922.

It is also known a method for producing such products described in the specified patent LT-A-4922, including a step of half-tone screening in which the main image is transmitted for printing by an ordered screen having a specified angle and lineature, and at least one latent image is transmitted by deformation of the ordered screen and to this end irregularities are introduced in the ordered screen, said irregularities not resulting in distortion of the main image. The given method allows to carry out quite complex deformation of the screen without its division into strictly defined zones that makes transitions less appreciable.

A test pattern is applied on the printed product to identify the latent image introduced in the screen of the main image, the test pattern in this case represents the deformed screen applied on a substrate used for application of the latent image. The test pattern when applied makes apparent any deviations in geometry of the screen as more dark and more light sections, the deviations even not exceeding one interval between the lines.

Realization of the given method requires solution of an algorithmically difficult problem of construction a screen with introducing additional variables in usual half-tone screening algorithm that essentially limits the possibilities. Also the problem of dot spread is disregarded at printing which in many cases results in appearing by tone of the latent image and patterns at printing. Identification of the latent image requires very exact positioning of the test pattern that is practically impossible to execute without additional magnifying technical equipment. Besides the mentioned method not always allows to reveal differences, visually precise displaying of the differences can not appear if the falsified specimen is printed by a screen with much higher lineature or a stochastic screen.

SUMMARY OF THE INVENTION

It is an object of the invention to provide a printed product containing besides the main image at least one additional latent image which is hidden from visualization which identification with high degree of reliability could be carried out at use of a quite simple, not complicated in production test pattern accessible to use for a broad circle of users, and also to provide a method for producing such products providing high degree of protection for the printed product and being economically advantageous at printing of large circulations.

This object is solved in that in the printed product comprising a carrier of a main image applied thereon transmitted by an ordered screen having a specified angle and lineature and at least one additional latent image which is hidden from visualization and transmitted by a deformed-structure screen, the latent image being identifiable by a test pattern applied on the printed product, according to the invention, the latent image is displayable when applied the test pattern comprising a transparent substrate with a linear screen applied thereto, and which lineature and angle are identical to those specified.

Besides, the visualization can be provided by application of a pattern comprising a transparent substrate with a relief formed on the surface thereof in form of a plurality of parallel grooves having angle and period of construction identical to the specified angle and lineature of the ordered screen.

In one of embodiment of the invention the additional image can be transmitted by a screen having a structure deformed perpendicularly to the angle of its construction in function of the additional image tone gradations, thus value of deformation is limited by a half of the screen elements construction period.

In another embodiment the additional image can be transmitted by a screen having a structure deformed perpendicularly to the angle of its construction in function of the additional image tone gradations, thus value of deformation is limited at least by one full period of the screen elements forming.

The printed product according to the preferable embodiment contains two additional latent images transmitted by a screen having a structure deformed perpendicularly and in parallel to the angle of its construction depending on tone gradation of the corresponding additional image.

In one additional embodiment the printed product comprises a main image which is transmitted in printing by two colors with application of linear screens having a 90 degree angle difference of half-tone screening, thus two additional latent images are formed, each image in one of the colors of the main image transmitted by screens of corresponding colors having a structure deformed in function of the given additional images tone gradations.

Thus in a preferable embodiment the main image is transmitted by an ordered screen having a specified angle of construction of 45 degrees, and the test pattern is formed for application the face side thereof for visualization of one additional image and for application the back side thereof for visualization of a second additional latent image.

In the most preferable embodiment the printed product has at least a semitransparent carrier, and a linear screen is printed on the back side thereof, the screen being identical to that on the test pattern, but in mirror-image representation for visualization of the latent image at viewing through the carrier.

The printed product can also comprise a main image transmitted by an ordered screen containing at least two different types of screen elements, thus the additional image can be transmitted by a deformed screen containing modified elements having transition forms in respect to types of the elements comprising the ordered screen transmitted the main image.

The object in view is also solved by a method for producing the printed product comprising a main image and at least one additional latent image which is hidden from visualization, including a step of half-tone screening in which the main image is transmitted to printing by an ordered screen having a specified angle and lineature, and the latent additional image is transmitted by deformation of the ordered screen, and to this end distortions are introduces in the ordered screen which distortions not causing deformation of the main image, according to the invention, the distortions are introduces by shifting the grid structure centers corresponding to the ordered screen, depending on the additional image tone gradations with forming a deformed grid structure consisting of a plurality of quadrangular meshes defining position and geometry of the deformed screen elements.

The shifting value is worthy to limit providing obligatory diagonals intersection of the formed quadrangular meshes.

To improve the quality of the main image it is preferable to provide washout of the additional image before the shifting.

With the same purpose it is preferable for each screen element, depending on its geometrical parameters and in view of predetermined by the user value of dot spread effect compensation, to specify a factor of tone gradations value decrease for the screened image of the given element.

The object in view is resolved, besides by a method for producing the printed product comprising a main image and at least one additional latent image which is hidden from visualization, the method including a step of half-tone screening in which the main image is transmitted to printing by an ordered screen having a specified angle and lineature, and the latent additional image is transmitted by deformation of the ordered screen, to this end the distortion is introduced in the ordered screen not resulting in distortion of the main image, according to the invention, the main image is transmitted by an ordered screen containing at least two different types of the screen elements and distortions are introduced to the ordered screen as modified elements representing transition forms between said different types of the screen.

In the method of this embodiment for each screen element it is preferably to specify a factor of the screened image tone gradations decrease value for the given element depending on its geometrical parameters and considering the value of compensation of the dot spread effect determined by the user.

BRIEF DESCRIPTION OF DRAWINGS

The invention will be further illustrated by the description of particular exemplary embodiments thereof and applied drawings, in which.

DETAILED DESCRIPTION OF THE INVENTION

The printed product according to the present invention contains a carrier made of, for example, paper, film, cardboard having a main visible to a naked eye image applied thereon, the image is transmitted by an ordered screen, and at least one additional latent image which is hidden from visualization and transmitted by a deformed-structure screen. The latent image can be visualized, i.e. become accessible to visual examination when a test pattern is applied to the printed product which test pattern comprises a transparent substrate with a linear screen applied thereto which lineature and angle of construction are identical to the lineature and angle of construction of the ordered screen by which the main image was transmitted or comprises a transparent substrate with a relief formed on its surface in the form of a plurality of parallel grooves which angle and period of construction is identical to the specified angle and lineature.

The printed product in the sense it is used in the present description, can comprise banknotes, securities, packing, labels, ornamental printed products and also any other printed product having a latent image for protection thereof against counterfeit or with any other purpose.

The additional latent image which is hidden from visualization can represent a figure, an inscription, a pattern or any other plane graphic element.

Figure 1:
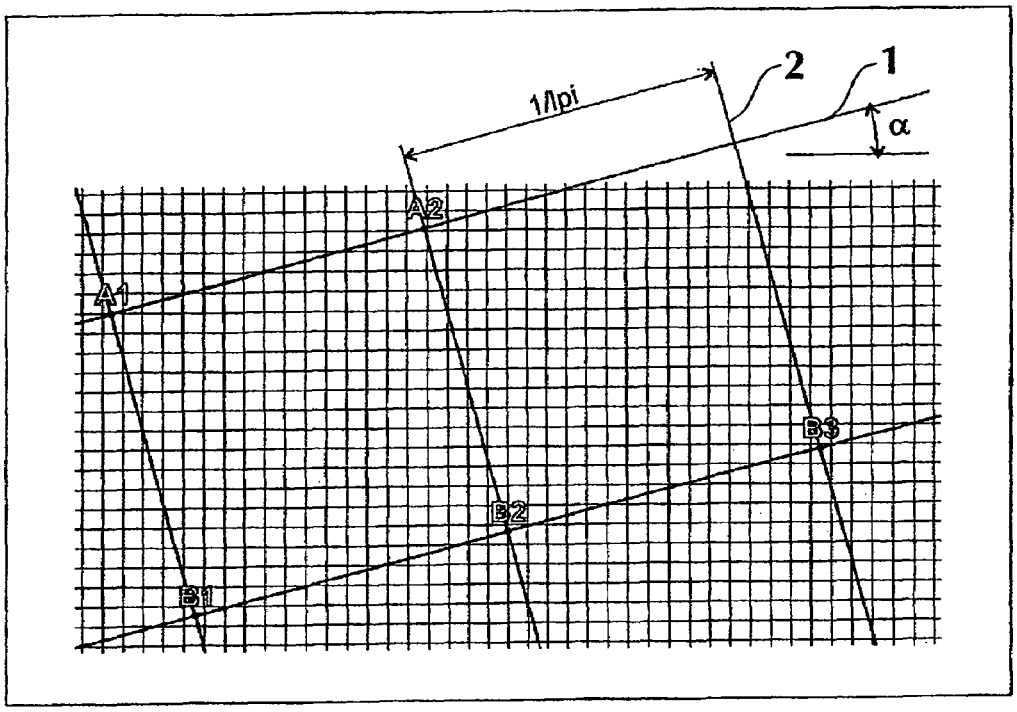
FIG. 1 shows a fragment of the ordered screen grid structure.

The method for producing a printed product, according to the invention, includes, at a step of half-tone screening the image thereon, forming a grid structure of the ordered screen which fragment is represented in FIG. 1, the grid structure being formed by crossed mutually perpendicular lines: vertical lines 1 (direction perpendicular to the screen construction angle) and horizontal lines 2 (direction parallel to the screen construction angle) which interval of construction is defined by predetermined values of lineature Lpi, and angle $\alpha$ is equal to the screen construction angle. Then deformation of the grid structure is carried out depending on tone gradations of the chosen additional image.

Figure 2:
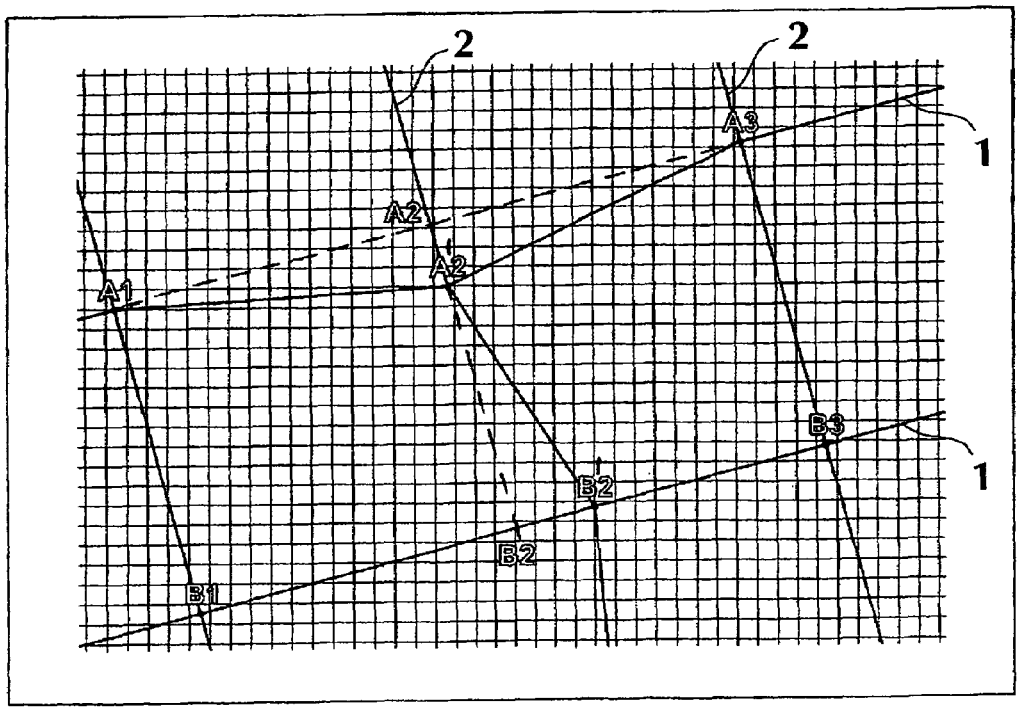
FIG. 2 is a fragment of the deformed screen grid structure.

FIG. 2 illustrates a fragment of the deformed grid structure showing a center $A_2$ of the grid structure displaced downwards in a direction perpendicular to the screen construction angle (along line 2), in a point $A_2'$, and center $B_2$ is displaced to the right in a direction parallel to the screen construction angle (along line 1), in a point $B_2'$.

Requirement of obligatory intersection of the deformed grid structure quadrangular meshes diagonals restricts deformation of the grid structure.

Figure 3:
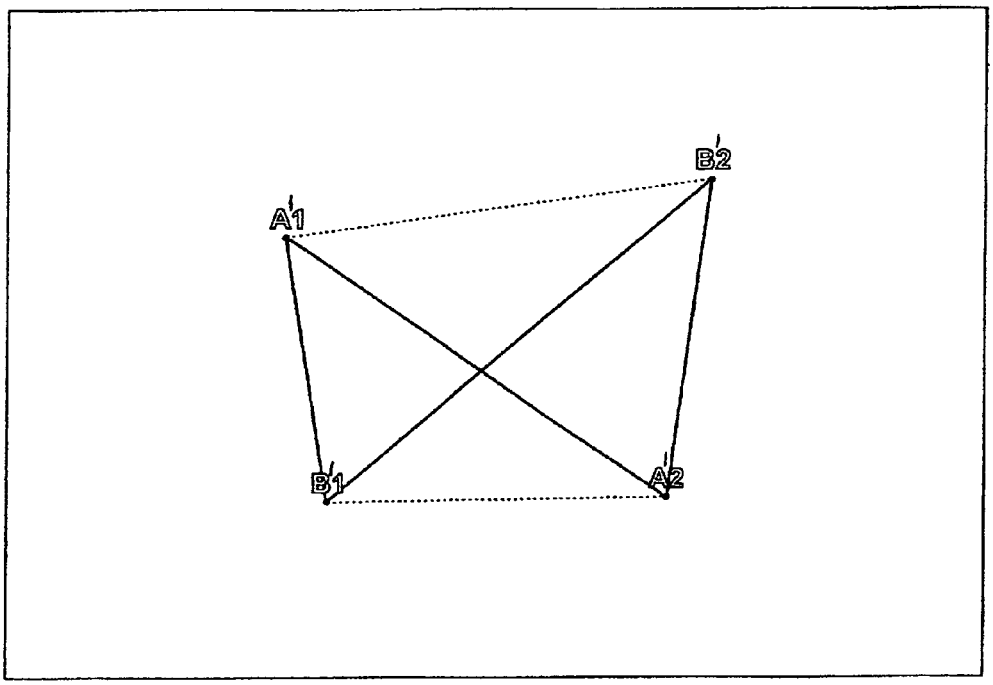
FIG. 3 is an exemplary illustration of the separate quadrangular mesh inadmissible deformation of the screen grid structure.

FIG. 3 represents an example of inadmissible deformation of the grid structure having diagonals $A_1'B_2'$ and $B_1'A_2'$ not intersecting, and quadrangular mesh $A_1'B_2'A_2'B_1'$ is transformed in two triangles interacting by vertexes.

If shifting value in view of the above restriction does not exceed a half of the screen elements construction period the additional latent image when the test pattern (an optical key) is applied is visualized preserving the preserved tints.

If deformation value is limited by at least one full period of the screen elements formation when an optical key is applied, the latent image is displayable in the form of a contour.

In case when different grid structure deformation conditions are specified in a direction parallel to the screen construction angle and perpendicular thereto, application of an optical key to the printed product visualize two different latent patterns or images. Which of the latent images is visualized depends on the turning angle of the optical key. If the screen construction angle $\alpha$ is 45 degrees the optical key is simply applied by back side to display the second image.

Figure 6:
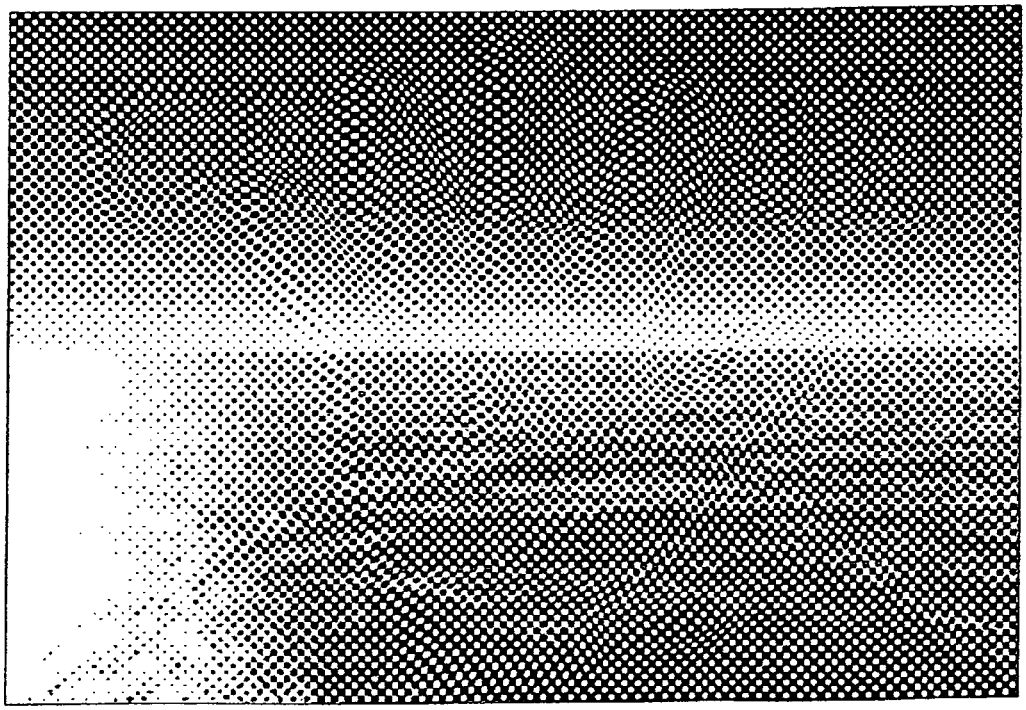
FIG. 6 is an exemplary illustration of a printed product, according to the invention, containing the main image and two additional latent images.
Figure 7:
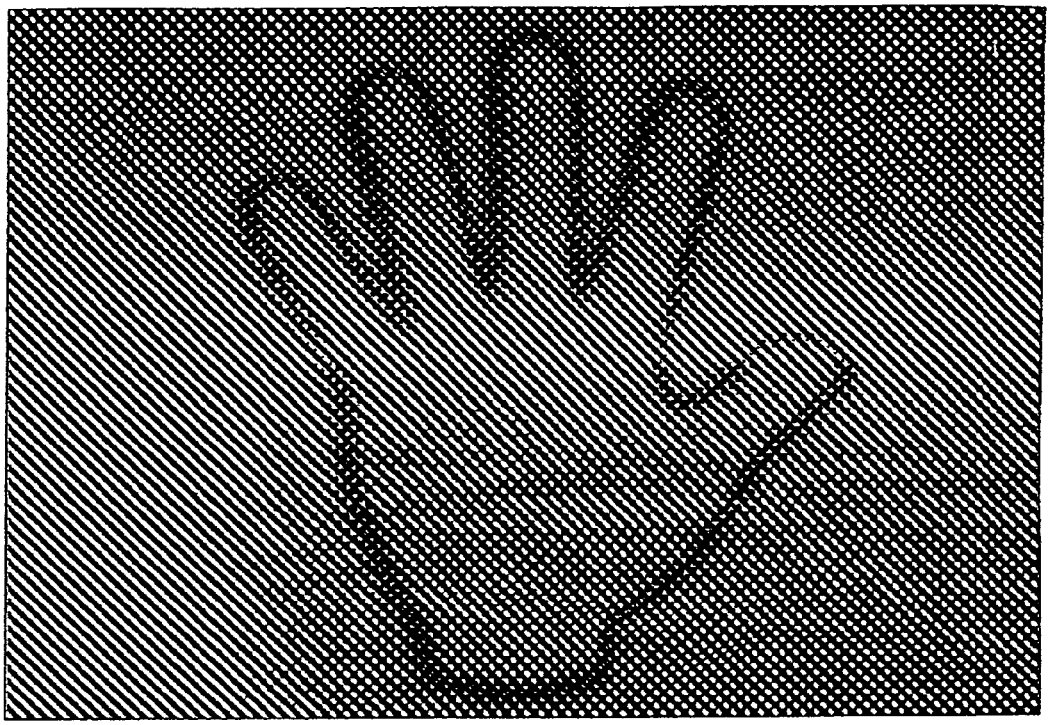
FIG. 7 is a printed product according to FIG. 6 with an apparent first latent image when applied a test pattern.
Figure 8:
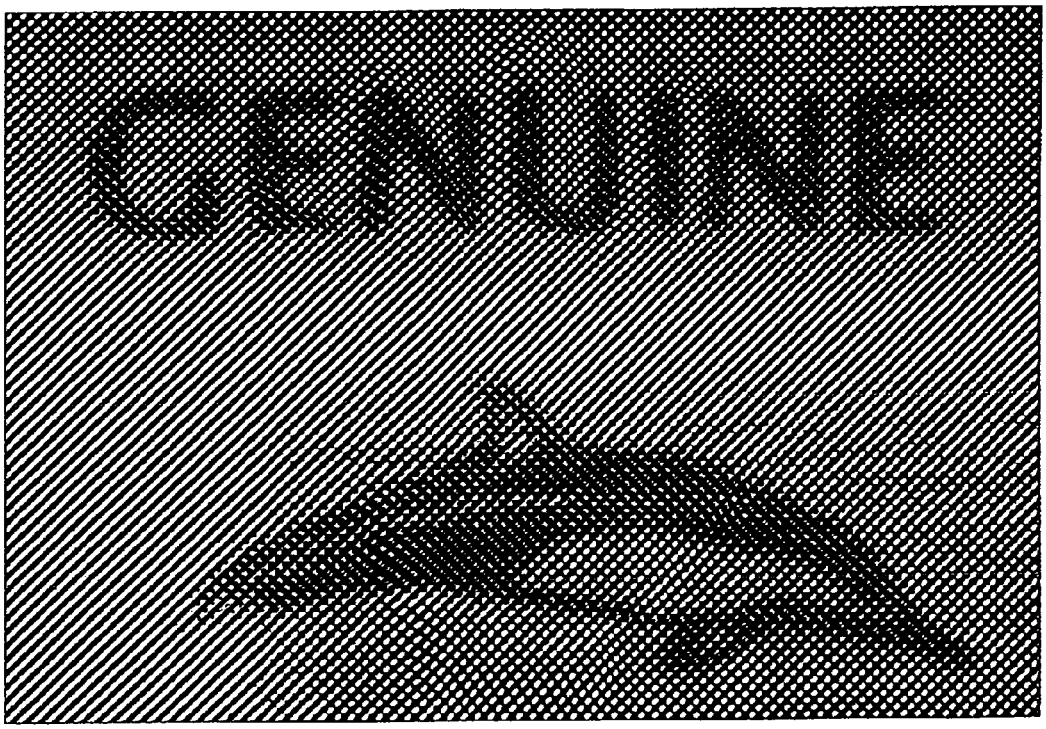
FIG. 8 is the same as FIG. 7 but with apparent second latent image when the pattern is applied from the back side.

FIGS. 6, 7 and 8 show an example of the printed product, according to the invention, containing two additional latent images in addition to the main image. In this example the screen construction angle has been chosen to be equal 45 degrees, one latent image is transmitted by a screen having a structure deformed perpendicularly to the direction of the predetermined angle of half-tone screening (on line 2) on a half of the screen elements construction period and the second latent image is transmitted by a screen having a structure deformed in parallel to the angle of its construction (on line 1) for one full period of the screen elements formation.

When applied on the image shown in FIG. 6 the test pattern in form of a transparent film with a linear screen applied thereto having construction angle of 45 degrees, in one case a contour image of a palm (FIG. 7) is visualized, and when the pattern is turned on 90 degrees (or when it is applied by its back side) the second latent image of a dolphin and inscription "GENUINE" is displayed, and the second image is visualized with preserving tints.

The printed product made with use of a light transmitting carrier, for example, of a not very dense paper having a screen applied on the back side of the carrier, the screen being identical to the linear screen of the test pattern (optical key) in a mirror representation, aligned with the image boundary lines on the face side of the printed product, allows to visualize the latent image when viewing through the carrier.

Since screen deformation structure is defined by the additional image, the image is first washed out to prevent inadmissible deformation of the grid structure in places of opposite tinctures boundaries and also to prevent exceeding by the generated screen lineature value, the value implemented in the production.

In that printed product embodiment when the final image is generated from two color layers at use of the "line" type screen, and with a 90 degree difference of screen construction angles, deformation in different directions is defined by two different latent additional images. Application of an optical key on such image at corresponding angles will display two latent images. In order not to call moiré at overlapping layers in such composition, deformation of the screen structure should be insignificant. Whether the latent image will be visualized with preserving of the tints or contour lines depends on the established deformation value as it was already mentioned above. Shifting the optical key on the surface of the examined product will change tinctures of the latent image.

At the second step of half-tone screening after construction of the grid structure forms (types) of the screen elements are determined for all meshes of the grid structure. All types of the screen elements are represented as half-tone images. The latter define positions and sequence of filling by the coloring agent the places which tone gradation of the screening image exceeds a certain value. The half-tone images representing corresponding types of the screen should not result in tone distortions of the screened image at subsequent printing.

Figure 4:
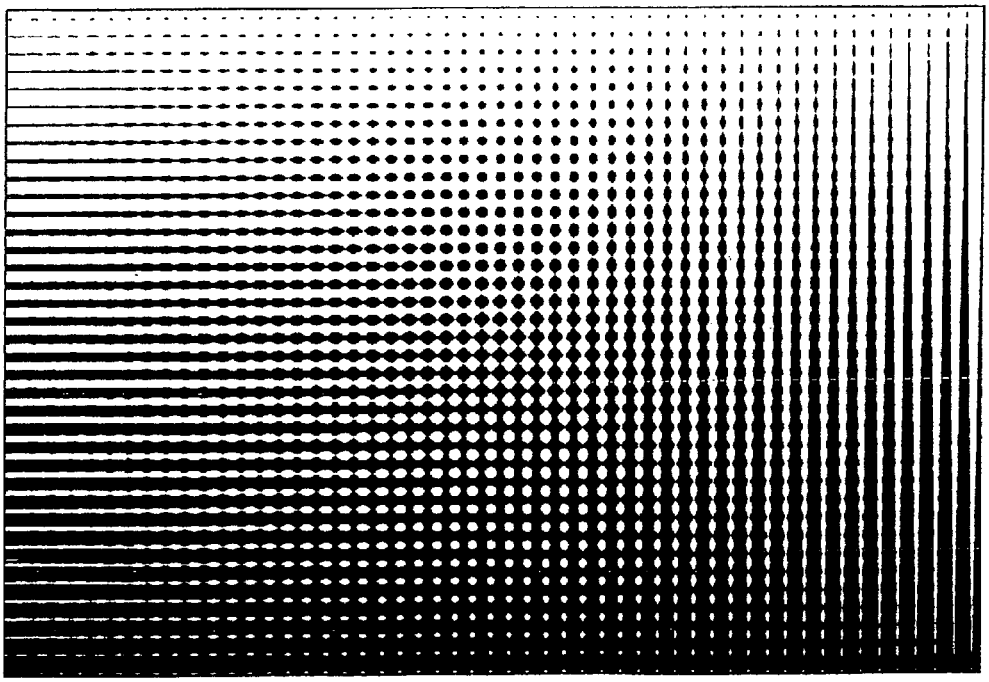
FIG. 4 is an exemplary illustration of the deformed screen containing three different types elements constituting it and two types of transition forms elements.

FIG. 4 illustrates an enlarged fragment of the printed product containing the main and additional latent image, and the additional image here is transmitted by a deformed screen containing elements modified in respect to the ordered screen. In the given instance the main image is transmitted by an ordered screen containing three different types of the screen elements: "line", "point" and "line turned on 90°". The additional image is transmitted by a deformed screen containing modified elements, representing transition forms in respect to the types of the ordered screen elements, namely transition forms between types of the elements "line" and "point" and between types "point" and "turned line".

Thus, a screened image is formed. The described alternatives of the method for producing a printed product allow to transmit a maximum number of fine details of the initial image at use of sufficiently large screen.

Irregularity of the generated screen does not allow to compensate the dot spread effect at printing using correction gamma of whole initial image. In this case a tone gradations value decrease factor of the screened images for a given element is determined for each element of the screen depending on its geometrical parameters and in view of the value of the dot spread effect compensation determined by the user. In offset printing the required compensation value depends on the determined color intensity in the apparatus outputting photopositives or forms. Thus the determined linearization has no importance (preferably the used apparatus and materials require minimal linearization), and the dot spread depends on adjustment of the printing-press (paint, moistening, pressing), on the chosen sort of paper and on the selected lineature value. The higher determined lineature value, the more attention should be given to the distortions compensations, though compensation value will be the same for all lineatures at equal resolution.

Figure 5:
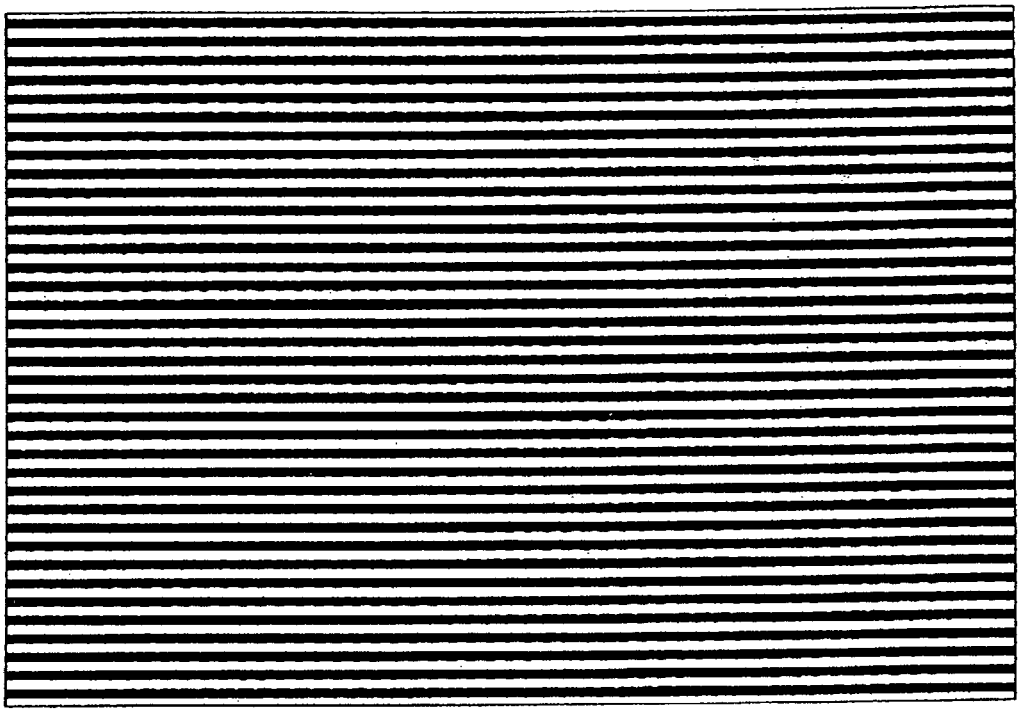
FIG. 5 shows a fragment of a test pattern, according to the invention.

In order to produce the optical key visualizing the latent image or patterns, a one-bit array of the same size as the printed product is created using the same values of lineature and screen construction angle which have been used for construction of the ordered screen, but without introducing of any distortions into the screen structure. A grey background of required intensity is used instead of the screened images; the screen type is a line. The obtained thus screen is applied on a transparent substrate, for example, a celluloid film. FIG. 5 illustrates an example of a screen with 0° construction angle which can be used for production of the optical key.

INDUSTRIAL APPLICABILITY

The method of half-tone screening, according to the invention, can be used in the most different printing technologies, from the offset printing to the office press tools. For each printing technology it is necessary to specify a corresponding value of lineature and dot spread compensation.

The printed product according to the invention does not require for the production thereof development of special equipment and can be identified at use of a test pattern (an optical key) which is simple in production, convenient in maintenance and allows to reproduce latent images with high degree of accuracy.

The invention claimed is:

1. A printed product comprising a carrier of a main image applied thereon transmitted by an ordered screen having a specified angle and lineature and at least one additional latent image which is hidden from visualization and transmitted by a deformed-structure screen, said latent image being identifiable by a test pattern applied on the printed product, wherein the latent image is displayable in preserved tints or contour lines when applied the test pattern comprising a transparent substrate with a linear screen applied thereto, and which angle and lineature are identical to those specified, and wherein the printed product comprises two additional latent images transmitted by a screen having a structure deformed perpendicularly and in parallel to the angle of its construction depending on tone gradation of the corresponding additional image, and wherein the main image is transmitted in printing by two colors with application of linear screens having a 90 degree angle difference of half-tone screening, thus two additional latent images are formed, each image in one of the colors of the main image transmitted by screens of corresponding colors having a structure deformed in function of the given additional images tone gradations.

2. A printed product according to claim 1, characterized in that the main image is transmitted by an ordered screen having a specified angle of construction of 45 degrees, and the test pattern is formed for application the face side thereof for visualization of one additional image and for application the back side thereof for visualization of a second additional latent image.

3. A method for producing the printed product comprising a main image and at least one additional latent image which is hidden from visualization, including a step of halftone screening in which the main image is transmitted to printing by an ordered screen having a specified angle and lineature, and the latent additional image is transmitted by deformation of the ordered screen, and to this end distortions are introduces in the ordered screen which distortions not causing deformation of the main image, wherein the distortions are introduced by shifting the grid structure centers corresponding to the ordered screen, depending on the additional image tone gradations with forming a deformed grid structure consisting of a plurality of quadrangular meshes defining position and geometry of the deformed screen elements, and thus the latent image is displayable in preserved tints or contour lines when applied the test pattern comprising a transparent substrate with a linear screen applied thereto, and which angle and lineature are identical to those specified, wherein the shifting value is limited to provide obligatory diagonals intersection of the formed quadrangular meshes and a washout of the additional image is provided before the shifting.

4. A method according to claim 3, characterized in that for each screen element, depending on its geometrical parameters and in view of predetermined by the user value of dot spread effect compensation, a factor of tone gradations value decrease is specified for the screened image of the given element.

5. A method for producing the printed product comprising a main image and at least one additional latent image which is hidden from visualization, the method including a step of half-tone screening in which the main image is transmitted to printing by an ordered screen having a specified angle and lineature, and the latent additional image is transmitted by deformation of the ordered screen, to this end the distortion is introduced in the ordered screen not resulting in distortion of the main image, wherein the main image is transmitted by an ordered screen containing at least two different types of the screen elements and distortions are introduced to the ordered screen as modified elements representing transition forms between said different types of the screen, and thus the latent image is displayable in preserved tints or contour lines when applied the test pattern comprising a transparent substrate with a linear screen applied thereto, and which angle and lineature are identical to those specified, and wherein a factor of the screened image tone gradations decrease value for the given element is specified to each screen element depending on its geometrical parameters and considering the value of compensation of the dot spread effect determined by the user.

6. A printed product comprising a carrier of a main image applied thereon transmitted by an ordered screen having a specified angle and lineature and at least one additional latent image which is hidden from visualization and transmitted by a deformed-structure screen, the latent image being identifiable by a test pattern applied on the printed product, characterized in that the latent image is displayable in preserved tints or contour lines when applied the test pattern comprising a transparent substrate with a relief formed on the surface thereon in form of a plurality of parallel grooves having angle and period of construction identical to the specified angle and a lineature.

7. A printed product comprising a carrier of a main image applied thereon transmitted by an ordered screen having a specified angle and lineature and at least one additional latent image which is hidden from visualization and transmitted by a deformed-structure screen, said latent image being identifiable by a test pattern applied on the printed product, wherein the latent image is displayable in preserved tints or contour lines when applied the test pattern comprising a transparent substrate with a linear screen applied thereto, and which angle and lineature are identical to those specified, wherein the printed product comprises two additional latent images transmitted by a screen having a structure deformed perpendicularly and in parallel to the angle of its construction depending on tone gradation of the corresponding additional image, and wherein the main image is transmitted by an ordered screen having a specified angle of construction of 45 degrees, and the test pattern is formed for application the face side thereof for visualization of one additional image and for application the back side thereof for visualization of a second additional latent image.

8. A printed product comprising a carrier of a main image applied thereon transmitted by an ordered screen having a specified angle and lineature and at least one additional latent image which is hidden from visualization and transmitted by a deformed-structure screen, said latent image being identifiable by a test pattern applied on the printed product, wherein the latent image is displayable in preserved tints or contour lines when applied the test pattern comprising a transparent substrate with a linear screen applied thereto, and which angle and lineature are identical to those specified and wherein the printed product comprises two additional latent images transmitted by a screen having a structure deformed perpendicularly and in parallel to the angle of its construction depending on tone gradation of the corresponding additional image, and wherein a linear screen is printed on the back side of a semi-transparent carrier, the screen being identical to that on the test pattern in mirror-image representation for visualization of the latent image at viewing through the carrier.

* * * * *